US010409313B2

(12) United States Patent
Bertani

(10) Patent No.: US 10,409,313 B2
(45) Date of Patent: Sep. 10, 2019

(54) MANEUVER ELEMENT INCORPORATING LOCKING MEANS

(71) Applicant: ELESA S.p.A., Milan (IT)

(72) Inventor: Alberto Bertani, Monza (IT)

(73) Assignee: ELESA S.p.A., Milan (IT)

( * ) Notice: Subject to any disclaimer, the term of this patent is extended or adjusted under 35 U.S.C. 154(b) by 0 days.

(21) Appl. No.: 15/722,723

(22) Filed: Oct. 2, 2017

(65) Prior Publication Data

US 2018/0101191 A1 Apr. 12, 2018

(30) Foreign Application Priority Data

Oct. 7, 2016 (IT) ..... 202016000100977

(51) Int. Cl.
*G05G 1/08* (2006.01)
*G05G 1/10* (2006.01)
(Continued)

(52) U.S. Cl.
CPC ..... *G05G 1/082* (2013.01); *G05G 1/085* (2013.01); *G05G 1/10* (2013.01); *G05G 5/18* (2013.01); *G05G 1/02* (2013.01); *G05G 5/005* (2013.01); *G05G 2505/00* (2013.01); *Y10T 74/20612* (2015.01)

(58) Field of Classification Search
CPC ..... G05G 5/18; G05G 1/082; G05G 5/005; G05G 1/10; G05G 1/085; G05G 2505/00; G05G 1/087; G05G 1/02; G05G 1/025; E05B 1/003; E05B 1/0038; Y10T 74/20744; Y10T 74/20732; H01H 19/003; A01K 89/015; A01K 89/0162; A01K 89/033; A01K 89/045; A01K 89/046; A01K 89/047; A01K 89/048; A01K 89/049;
(Continued)

(56) References Cited

U.S. PATENT DOCUMENTS 7,568,367 B2 * 8/2009 Huang ..... A44B 11/266 70/284
7,695,031 B2 * 4/2010 Jackson, Jr. ..... E05B 1/0038 292/169
(Continued)

*Primary Examiner* — Jeremy R Severson
(74) *Attorney, Agent, or Firm* — Pearne & Gordon LLP

(57) ABSTRACT

Maneuver element of the type composed by an element provided, on each end, with a protruding grip and centrally with safety means which can be activated under pressure and controlled from outside, apt to engage the structure on which it is mounted and to prevent the rotation, said pressure activated means, being composed of a button system having a central hole, housed within a depression of said maneuver element, and partially protruding from it, from the base of said button system abutting engaging and retaining plugs, housed free to move longitudinally within the holes obtained in said maneuver element, characterized in that fast remote identification means of the functionality of said maneuver and pressure fast activation means of said engaging and retaining plugs are associated with said button system, said pressure fast activation means of said plugs being composed by the association of engaging elements mounted on a rotor with driving and retaining elements provided on a stator complementary to said rotor.

14 Claims, 5 Drawing Sheets

(51) Int. Cl.

| | |
|---|---|
| ***G05G 5/18*** | (2006.01) |
| *G05G 1/02* | (2006.01) |
| *G05G 5/00* | (2006.01) |

(58) Field of Classification Search
CPC .... A01K 89/05; A01K 89/051; A01K 89/052; A01K 89/053
See application file for complete search history.

(56) References Cited

U.S. PATENT DOCUMENTS

| | | | | |
|---|---|---|---|---|
| 9,188,408 | B2 * | 11/2015 | Huynh | F41G 1/22 |
| 2014/0260770 | A1 * | 9/2014 | Bertani | G05G 1/082 74/523 |

* cited by examiner

MANEUVER ELEMENT INCORPORATING LOCKING MEANS

TECHNICAL FIELD

The present application relates to a maneuver element for mobile elements which incorporates locking means apt to prevent the rotation on command.

BACKGROUND OF THE INVENTION

These devices have been known for a long time and for a large variety of uses and applications, in particular on machines or machineries. Generally, they are composed of a crown, usually circular, from which handle and maneuver means abut, in some cases provided with a grip.

Depending on the different needs, the devices on the market can provide, or not, elements apt to stop the rotation of the maneuver shaft.

In order to obtain the movement of the mobile element on which the maneuver element is assembled only in maximum safety, and only at the hands of authorized operators, safety pressure means are provided and monitored from outside in order to engage, when activated, the structure on which the element is assembled and to prevent the rotation. At the moment, such means are composed by a piston, axially mobile, protruding outwardly and internally bearing at least one protruding pin and, in the structure on which the element is assembled, a variety of holes apt to receive said pins.

If required, the maneuver element is provided with a door lock of its axial shifts, for example in order to avoid manumissions or handling mistakes.

Usually, the safety means are composed of a grip element, protruding from the maneuver element, equipped with retractable protruding plug elements, from the bottom surface of the maneuver element and apt to engage holes provided on the surface on which the maneuver element is mounted. The movement of the grip element typically occurs through a push-pull system.

Such device type is assembled on machines and machineries, but in particular on closets for mobile archives: it is, therefore, extremely necessary that the operator is immediately informed and without doubt, whether the device is in maneuver position or it is blocked, in order to operate in complete control and safety.

For this purpose, in a previous patent, the applicant has provided that the grip element provided a dome structure provided with a central hole, in said hole houses being housed a cup button, hold in fixed position through the application between the spring means and the seal means provided within the central cavity of the dome structure. In this way, the remote identification of the lock status of the device is ensured. In particular, in order to facilitate the recognition of lock status, the cup button shows, on the lateral surface, a different coloring from the grip element, for example red.

Even if the solution here anticipated carries out its own scope, in an optimal way, the applicant could observe that still there were improvement margins in particular to make more visible, also in position of rest, the device functionality and to make easier the movement of the grip element. It was indeed noticed, from one side that the signal just when the system was locked was not always easy reading to the operators' eyes, and from the other one that the push-traction movement system revealed itself, in some cases, complex.

Object of the invention is therefore the overcoming of said disadvantages, realizing a maneuver element equipped with safety means of simple management and which presents means apt to indicate the functionality of the maneuver element in immediate way.

Furthermore, the applicant aimed to realize maneuver element having block elements which incorporate the rules proposed by the ADA ACT, and with particular attention to the "ADA standards for accessible design". In these rules, it is clearly required to provide maneuver elements which can be activated with only a hand and which do not require a tight hold, pressing or wrist twisting. Besides, it is required that the maneuver element can be activated using, at most, a 20,2 N strength.

Further object is therefore to obtain a maneuver element which is compliant with the rules established by the ADA ACT.

Said objects are obtained through a maneuver element of the type composed by a element provided, on each end, with a protruding grip and centrally with safety means which can be activated under pressure and controlled from outside, apt to engage the structure on which it is mounted and to prevent the rotation, said pressure activated means, being composed of a button system having a central hole, housed within a depression of said maneuver element, and partially protruding from it, from the base of said button system abutting engaging and retaining plugs, housed free to move longitudinally within the holes obtained in said maneuver element, characterized in that fast remote identification means of the functionality of said maneuver and pressure fast activation means of said engaging and retaining plugs are associated with said button system, said pressure fast activation means of said plugs being composed by the association of engaging elements mounted on a rotor with driving and retaining elements provided on a stator complementary to said rotor.

BRIEF DESCRIPTION OF THE FIGURES

The invention is now described in more detail, exclusively for example with reference to the attached drawings, in which.

DETAILED DESCRIPTION

Figure 1:
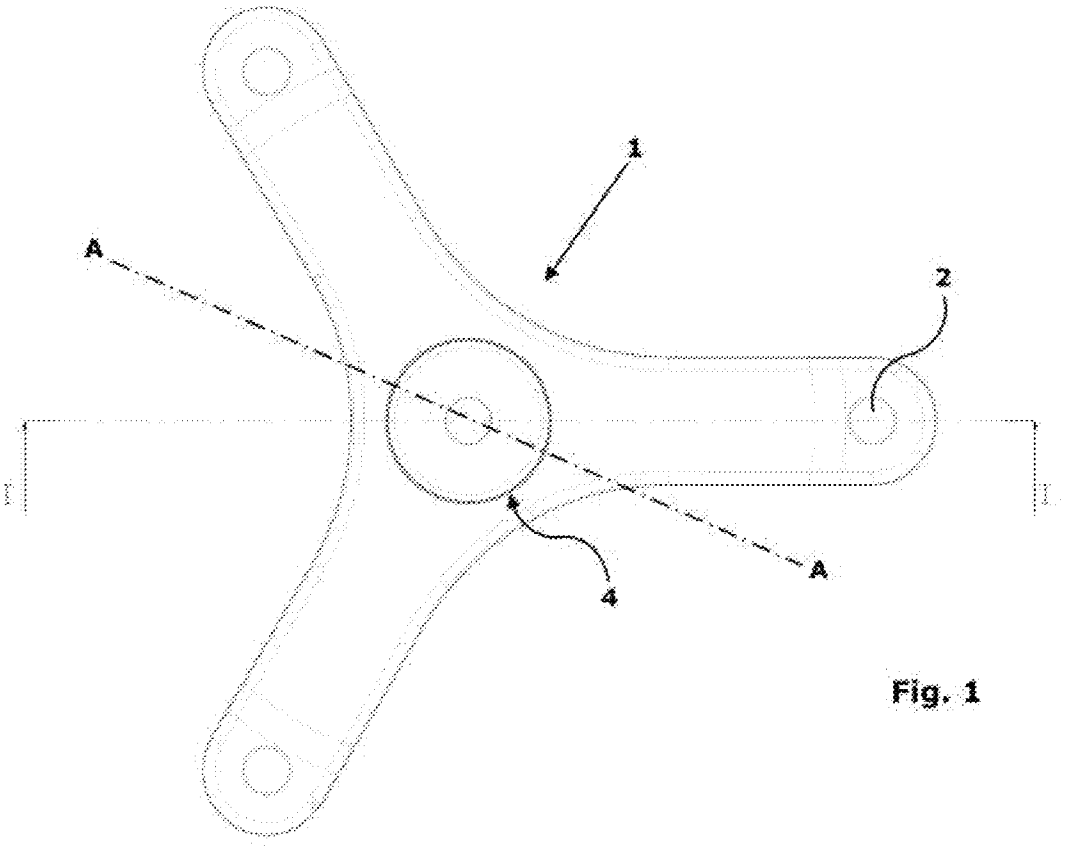
FIG. 1 is a view with a view from above of a maneuver element of a mobile element according to the invention.
Figure 2:
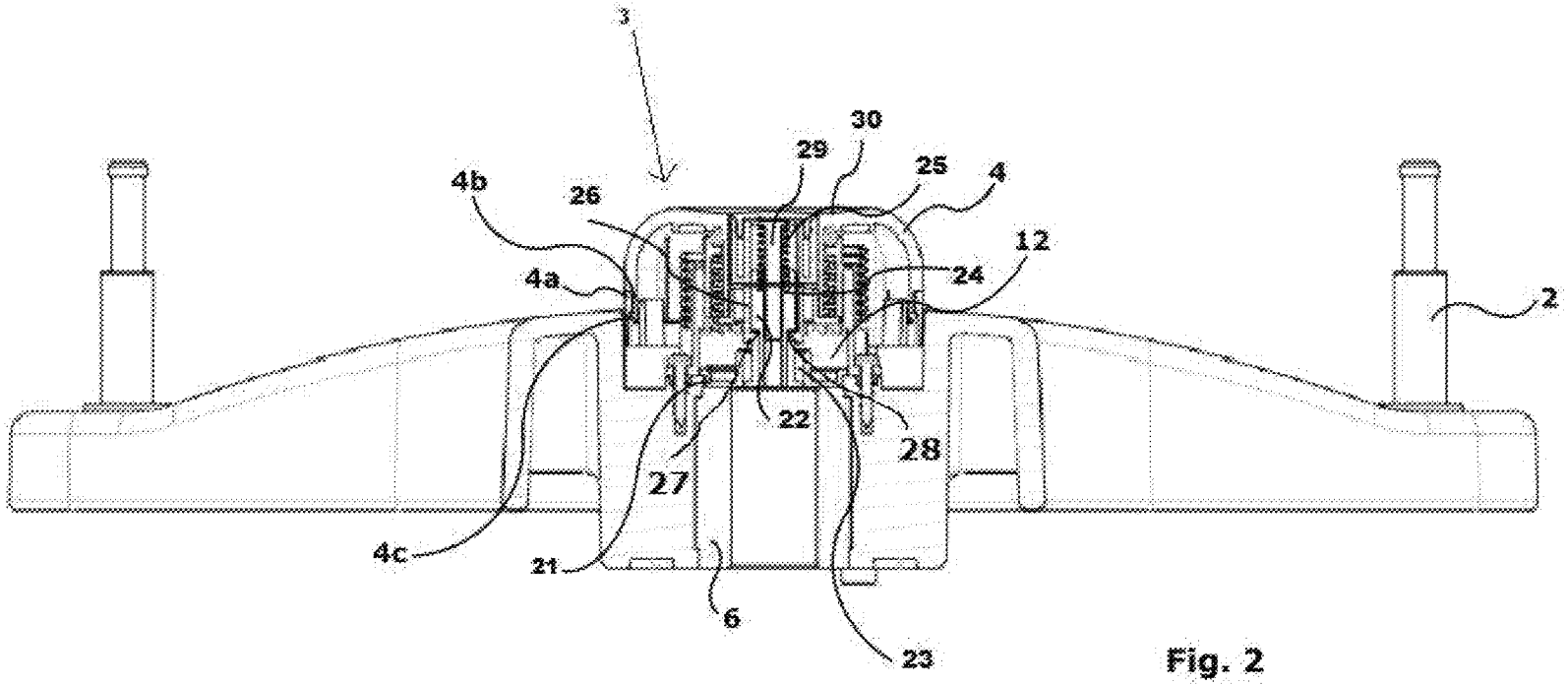
FIG. 2 is a view partially in section along the line I-I of FIG. 1 of the maneuver element of FIG. 1.
Figure 3:
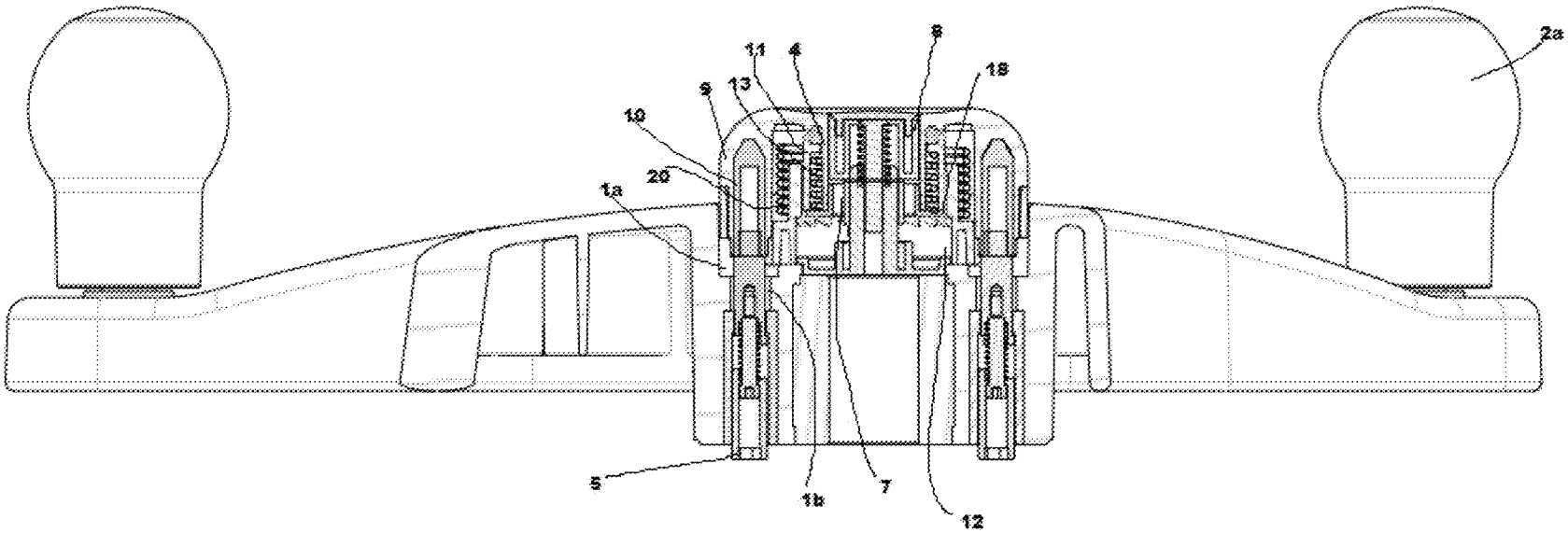
FIGS. 3 and 4 are sights in longitudinal section along the line A-A of the maneuver element of FIG. 1, respectively in movement and retaining position.
Figure 4:
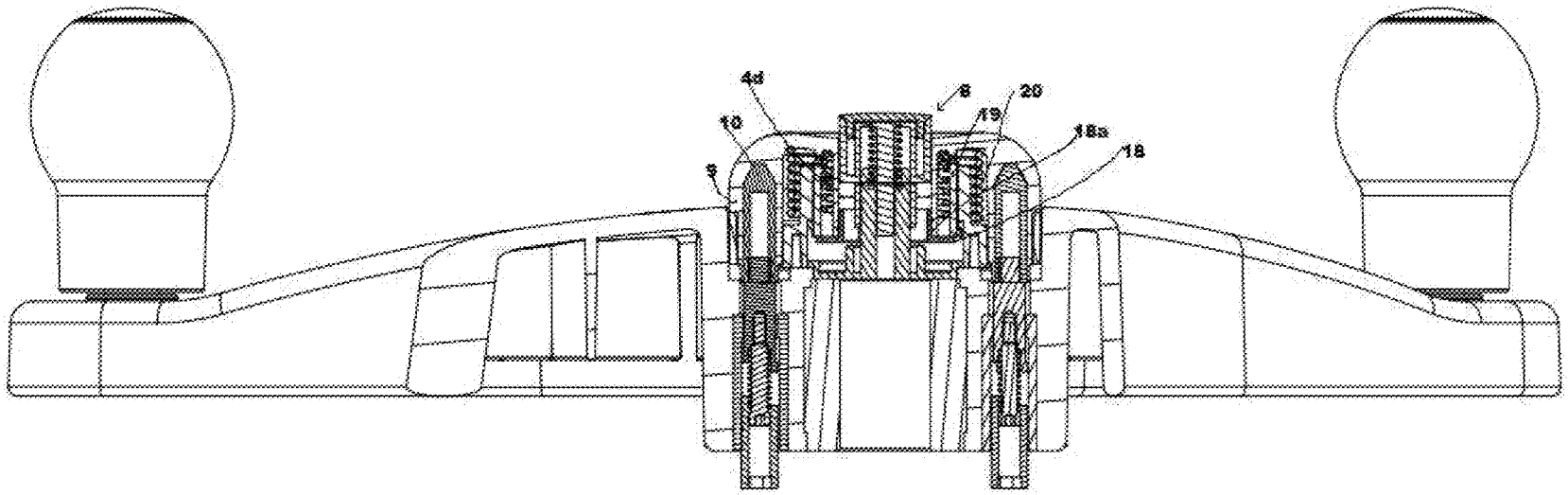
Figure 6:
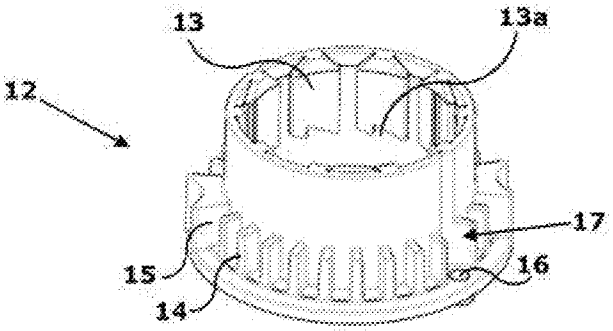
FIG. 6 is the view in perspective of a stator provided inside the device according to the invention.
Figure 5:
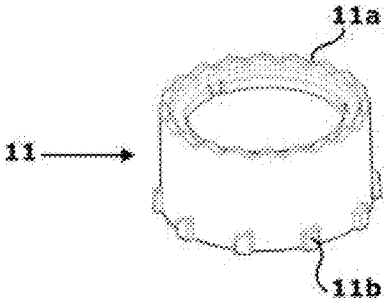
FIG. 5 is the view in perspective of a rotor provided inside the device according to the invention.

The maneuver element 1 is composed by a trilobal element, provided, in every end, with housing plugs 2 of a protruding grip (not shown), and centrally equipped with management system 3 for the movement of a mobile element, apt to secure the maneuver element 1 towards the movement of the same, henceforward defined as "safety system 3".

The maneuver element 1 is internally shaped in order to correctly house, and to allow the functioning, the above referenced safety system 3. In particular, it provides: a depression 1*a* for the housing of the maneuver means 4 of the safety system 3, through holes 1*b* on the base of the above referenced depression 1*a* to allow the sliding of engaging and retaining elements 5 through the element 1 apt to the insertion within the wall on which the maneuver element 1 itself is installed.

Below the depression 1*a* and in correspondence of the same, the maneuver element provides a bush 6 apt to house a transmission shaft of the rotation (not shown).

Analyzing now the safety system 3, it is composed by said maneuver means 4, having the shape of a dome—centrally hollow—button, which presents, in proximity of its bottom, a circumferential groove 4*a*, delimited by a lower notch 4*b* apt to engage a ring 4*c* properly having a tooth shape in order to obtain a tight engagement in the groove 4*a*. The ring 4*c* has a different colouring in comparison to the rest of the cover element, preferably having a tone which can also remotely stand out, such as the green color.

Internally, said button 4 has a circumferential wall 4*d* apt to define a channel 7 housing an indicator element 8, the features and functionality of which will be described thereafter, and a wall 9 having the principal function of keeping in steady position a support bush 10 of the engaging and retaining elements 5, having the shape of cylindric plugs. Associated with the button 4 is a rotor 11, which determines, in combination with a stator 12, the pull and push mechanism.

The rotor 11 is composed by an annular element having, at an end, a crown 11*a* thinner respect to the rest of the ring, the pattern of which is at inclines planes. At the opposite end, the rotor 11 provides a series of guidance teeth 11*b*, having the angled summit, disposed equidistant along the external surface.

The stator 12 is in turn composed of a cylindric flanged bush at one end, which provides, along the internal wall, polygonal driving and retaining isles 13, shaped at the bottom in order to recognize a notch 13*a* apt to restrain the guidance teeth 11*b* in steady position, without requests, and—in the same time—to support the disengagement whenever it is impressed a correct strength.

Along the flanged surface, two series of equidistant ribs 14 abut, being reciprocally separated by opposed and identical cradles 15 apt to house the said plugs 5. Housing through holes 16 are also provided in order to fix screws of the stator 12 to the element 1, in correspondence of which, along the vertical surface of the stator 12 itself niches 17 for housing said screws.

In order to hold the rotor 11 is provided a flanged cover 18 equipped with engaging notches 18*a*, along the vertical external surface, with complementary groove obtained on the more internal surface of the internal wall 4*d* of the button 4.

Between the external surface of the internal wall 4*d* of the button 4 and the rotor 11 it is preferably incorporated a setting spring of the movement 19 of the rotor 11 itself. Likewise, between the external surface of the stator 12 and the wall 9 it is incorporated a spring 20 apt to set the movement of the button 4.

Internally to the button 4, centrally housed in the depression 1*a* and in contact with the bush 6, the indicator element 8 is composed by a basement 21 having a circular base from which a centrally hollow cylindric element 22 develops, said element 22 being below equipped with a circular cavity 23 and at one top of a circular groove 24 apt to house a spring 25, and by a sleeve 26 connected to it in stable engagement. In the same way, the sleeve 26 is composed by a cylindric element having on one end a hook 27 and on the other end a cup appendix 28 which is in contact with the internal wall of said button.

In order to oppose the spring 25, on the opposite end respect to the end inside the groove 24, a plug with head 29 is provided, housed within the hole provided in the hollow cylindric element 22. In order to close the indicator element 8 it is provided a cap 30 apt to be inserted in the chamber composed by the cup appendix 28 and which finds stable engagement with it through a toroidal engagement groove—notch.

Preferably, the indicator element 8, or at least its cup appendix 28 has a different color respect to the rest of the device, preferably of a tone which can also remotely appear, as the red colour.

In the functioning, the device is relatively easy to understand.

In the phase of free movement of the mobile element, the operator can also remote identify the state of activation of the maneuvering element through the colored element provided on the button, and can therefore proceed with the rotation of the maneuver element. Once the operator has shifted the mobile element for the necessary space, and desires to proceed with its activities inside it, in order to be sure there are no undesired movements (and often dangerous), he has just to press the button. This leads to an input of the plugs within the holes provided in the mobile element according a system per se known.

Upon pressing the button, the guidance teeth of the rotor come out of the housing of the stator and the rotor can rotate on inclined planes on which it is supported. Once such rotation has taken place, the rotor can keep on rotating on the stator, positioning itself in the action position. When it is desired to unlock the device, it is sufficient to press the button again: the guidance teeth of the rotor comes out the stator place, rotating due to the inclined supports between the stator and the internal surface of the button, and follow the guidance in the stator returning to the initial position. The external spring determines the re-positioning of the motor unit in the initial position. In a few words: the central spring is required to make the rotor rotate and has determined the two positions of the same. The motor unit supports the rotor through the metal ring. The external spring pushes again the button into the initial position. The rotation between the stator and the rotor is activated by the inclined planes between the motor unit and the rotor and continues with the inclined coupling between the stator and rotor.

Referring to the indicator element, the particular conformation allows its temporary lowering exactly when the user pushes the button, and the subsequent return in rest position when the user gets away due to the spring associated to it. The choice of the red colour allows the operator to recognize at a distance the activation status of the same device.

It could be understood that the now described system consents to obtain in egregious way a maneuver element equipped with safety means at sensor-systems capable of immediately indicate the status of functionality, also at distance.

If greater safety is required, also lock means are provided in order to keep blocked the maneuver element in this position. In this case, at the end of the first phase, the user will be at ease when turning the key, to allow the system not to be accidentally unlocked, according to procedures known in the technique.

In particular, it has been obtained to avoid that the user pushes or pulls the central actuator, allowing instead the user to push it with a restrained strength, as expressively required by the ADA Act.

It could be noted that other, different from the one described and illustrated in details more above, could be the embodiments of the maneuver element according to the invention which achieves utilities equal to those described.

For example, it is not necessary that the maneuver element is composed by a handle as the one described now: it could be a disk wheel, or a ray steering wheel, or a device with two or three arms, with or without maneuver handle. Besides, the retaining means could be applied to the element in different position from the one described. Finally, it could provided more than one button. All these solutions are naturally part, in their own right, in the protection field of the present invention.

The invention claimed is:

1. A maneuver element comprising:

an element having at least one arm with a protruding grip disposed on an end thereof, and safety means provided at a central location of the element wherein the safety means is pressure activated and monitored from outside, apt to engage a structure on which it is mounted, and configured to prevent rotation, the safety means comprising:

a button system having a central hole, the button system being disposed within a depression of the element, and partially protruding therefrom, wherein a base of the button system abuts and engages retaining plugs that are positioned within holes of the element and are free to move longitudinally therein, wherein fast remote identification means of the functionality status of the maneuver element and pressure fast activating means of said retaining plugs are associated with the button system, wherein the pressure fast activating means of the retaining plugs comprises an association of engaging elements, mounted on a rotor , with driving and retaining elements provided on a stator that is complementary to the rotor, where the fast remote identification means comprises an indicator element disposed within the central hole of the button system such that a user can engage the indicator element, and wherein the indicator element is vertically translatable between first and second positions.

2. The maneuver element of claim 1, wherein the rotor is associated with a flanged cover provided with engaging notches on an external vertical surface thereof, and wherein the engaging notches are apt to engage with an internal surface of the button system, and wherein a spring is interposed between an external surface of the internal wall and the rotor itself.

3. The maneuver element of claim 1, wherein a spring is disposed between an external surface of the stator and a wall, and wherein the spring is apt to set a movement of the button element.

4. The maneuver element of claim 1, wherein the engaging elements comprise teeth having angled tops disposed equidistant along an external surface of an end of the rotor.

5. The maneuver element of claim 1, wherein the retaining elements are disposed on the stator and are comprised of polygonal isles, a base of which provides a notch apt to keep, in a steady position, the engaging element.

6. The maneuver element of claim 1, wherein the fast remote identification means comprises an annular element that is held in steady engagement with a bottom end of the button system.

7. The maneuver element of claim 6, wherein the annular element comprises a combination of a tooth element with a groove delimited by an engaging notch provided on an external surface of the bottom end of the button system.

8. The maneuver element of claim 6, wherein the indicator element comprises a cylindric element extending from a circular base, and wherein an upper portion of the cylindric element includes a circular groove configured to house a spring therein, and wherein the spring is held in steady engagement with the cylindric element by a sleeve.

9. The maneuver element of claim 8, wherein the sleeve comprises a cylindric element having at one end a hook and on an opposite end a driving and retaining seat of the spring.

10. The maneuver element of claim 9, further comprising an actuator that is moved by exerting pressure on it.

11. The maneuver element of claim 6, wherein the fast remote identification means comprises a different color in comparison to other elements of the maneuver element.

12. The maneuver element of claim 11, wherein the annular element is green and the indicator element is red.

13. The maneuver element of claim 1, wherein a top surface of the indicator element is positioned at a top surface of the button system when the indicator element is in the first position, and wherein the top surface of the indicator element is positioned above the top surface of the button system when the indicator element is in the second position.

14. The maneuver element of claim 1, wherein a top surface of the indicator element is positioned below a top surface of the button system when the indicator element is in the first position, and wherein the top surface of the indicator element is positioned above the top surface of the button system when the indicator element is in the second position.

* * * * *